US011712109B2

(12) United States Patent
Choi

(10) Patent No.: US 11,712,109 B2
(45) Date of Patent: Aug. 1, 2023

(54) RETAINER AND FRAME HAVING SAME

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 0 days.

(21) Appl. No.: 17/583,087

(22) Filed: Jan. 24, 2022

(65) Prior Publication Data

US 2022/0295980 A1 Sep. 22, 2022

(30) Foreign Application Priority Data

Mar. 16, 2021 (CN) ..... 202120546345.2

(51) Int. Cl.
*A47B 3/083* (2006.01)

(52) U.S. Cl.
CPC ..... *A47B 3/083* (2013.01)

(58) Field of Classification Search
CPC ..... A47B 3/083; A47B 3/087
See application file for complete search history.

(56) References Cited

U.S. PATENT DOCUMENTS

| | | | |
|---|---|---|---|
| 1,063,642 | A | 6/1913 | Birdsell |
| 2,136,569 | A | 11/1938 | Trimpi |
| 2,803,033 | A | 8/1957 | Rachman |
| 2,803,050 | A | 8/1957 | Birger Fernberg |
| 2,868,599 | A | 1/1959 | Roggio |
| 3,075,809 | A | 1/1963 | Wilson |
| 3,187,373 | A | 6/1965 | Fisher |
| 3,368,504 | A | 2/1968 | Cohen |
| 3,410,232 | A | 11/1968 | Bills |
| 3,410,327 | A | 11/1968 | Ausnit |
| 3,861,328 | A | 1/1975 | Lawless |
| 4,191,111 | A | 3/1980 | Emmert |
| 4,285,105 | A | 8/1981 | Kirkpatrick |
| 4,561,108 | A | 12/1985 | Kamp |
| 4,792,240 | A | 12/1988 | Ausnit |
| 5,325,794 | A | 7/1994 | Hontani |
| 5,483,710 | A | 1/1996 | Chan |
| 5,745,954 | A | 5/1998 | Shogan |
| 5,857,229 | A | 1/1999 | Magnani, Jr. |
| 6,223,366 | B1 | 5/2001 | Cheng |
| 6,363,550 | B1 | 4/2002 | Wang |

(Continued)

FOREIGN PATENT DOCUMENTS

| | | | |
|---|---|---|---|
| CA | 2971886 A1 | 12/2018 | |
| DE | 4321853 A1 * | 1/1995 | ..... A47B 3/0913 |

(Continued)

*Primary Examiner* — Matthew W Ing
(74) *Attorney, Agent, or Firm* — Morgan, Lewis & Bockius LLP

(57) ABSTRACT

A foldable frame includes first and second mounting assemblies pivotally connected to each other and rotatable with respect to each other between a folded position and an unfolded position. A foldable frame also includes one or more retainers. A retainer has a first coupler and a second coupler, with one disposed at the first mounting assembly and the other at the second mounting assembly. When the first and second mounting assemblies are in the folded position, the first and second couplers of each retainer engage with each other, and thus retain the first and second mounting assemblies in the folded position and prevent the foldable frame from accidental unfolding.

22 Claims, 11 Drawing Sheets

(56) References Cited

U.S. PATENT DOCUMENTS

| | | | | |
|---|---|---|---|---|
| 6,508,262 | B1 | 1/2003 | Takayama | |
| 6,843,183 | B2 | 1/2005 | Strong | |
| 6,971,321 | B1 | 12/2005 | Strong | |
| 7,059,254 | B2 | 6/2006 | Strong et al. | |
| 7,096,799 | B2 | 8/2006 | Strong et al. | |
| 7,097,380 | B2 | 8/2006 | Lee | |
| 7,171,910 | B2 | 2/2007 | Neunzert et al. | |
| 7,260,871 | B2 | 8/2007 | Borchardt | |
| 7,428,872 | B2 | 9/2008 | Strong et al. | |
| 7,475,643 | B2 | 1/2009 | Haney et al. | |
| 7,475,644 | B2 | 1/2009 | Strong et al. | |
| 7,634,969 | B2 | 12/2009 | Neunzert et al. | |
| 7,640,870 | B2 | 1/2010 | Strong et al. | |
| 7,644,667 | B2 | 1/2010 | Strong et al. | |
| 7,735,431 | B2 | 6/2010 | Neunzert et al. | |
| 7,874,303 | B2 | 1/2011 | Xie | |
| 8,006,630 | B2 | 8/2011 | Strong et al. | |
| 8,033,228 | B2 | 10/2011 | Haney et al. | |
| 8,042,475 | B2 | 10/2011 | Larcom et al. | |
| 8,113,130 | B2 | 2/2012 | Leng | |
| 8,156,875 | B2 | 4/2012 | Neunzert et al. | |
| 8,302,541 | B2 | 11/2012 | Haney et al. | |
| 8,342,107 | B2 | 1/2013 | Mover et al. | |
| 8,534,205 | B1 | 9/2013 | Johnson et al. | |
| 8,578,865 | B2 | 11/2013 | Haney et al. | |
| 8,622,007 | B2 | 1/2014 | Peery et al. | |
| 8,746,155 | B2 | 6/2014 | Haney et al. | |
| 8,757,069 | B2 | 6/2014 | Peery et al. | |
| 8,904,943 | B2 | 12/2014 | Jin | |
| 9,027,952 | B2 | 5/2015 | Zhu | |
| 9,103,368 | B2 | 8/2015 | Mendes | |
| D748,418 | S | 2/2016 | Johnson et al. | |
| 9,277,808 | B2 | 3/2016 | Cai et al. | |
| 9,282,812 | B2 | 3/2016 | Chang | |
| D756,694 | S | 5/2016 | Johnson et al. | |
| 9,351,563 | B2 | 5/2016 | Bennett et al. | |
| 10,470,561 | B2 | 11/2019 | Clegg et al. | |
| 10,806,246 | B1 * | 10/2020 | Chen | A47B 3/0815 |
| 2003/0089286 | A1 | 5/2003 | Wang | |
| 2004/0187749 | A1 * | 9/2004 | Zhurong | A47B 3/087 108/130 |
| 2005/0005826 | A1 | 1/2005 | Strong | |
| 2005/0097829 | A1 | 5/2005 | Seo | |
| 2005/0241550 | A1 | 11/2005 | Neunzert | |
| 2005/0279260 | A1 * | 12/2005 | Stanford | A47B 3/091 108/115 |
| 2006/0062632 | A1 | 3/2006 | Jang | |
| 2006/0196395 | A1 | 9/2006 | Lin | |
| 2007/0079441 | A1 | 4/2007 | Chen | |
| 2008/0078310 | A1 | 4/2008 | VanNimwegen | |
| 2013/0000528 | A1 | 1/2013 | Jin | |
| 2013/0025509 | A1 | 1/2013 | Jin | |
| 2013/0233210 | A1 | 9/2013 | Jin | |
| 2014/0030012 | A1 | 1/2014 | Lee | |
| 2014/0070070 | A1 | 3/2014 | Shinoda | |
| 2014/0099155 | A1 | 4/2014 | Chen | |
| 2014/0130837 | A1 | 5/2014 | Sy-Facunda | |
| 2016/0348395 | A1 | 12/2016 | Jin | |
| 2017/0013955 | A1 * | 1/2017 | Lin | A47B 3/087 |
| 2018/0153302 | A1 | 6/2018 | Jiang | |
| 2019/0150608 | A1 | 5/2019 | Johnson et al. | |
| 2019/0284831 | A1 | 9/2019 | Volin | |
| 2019/0292808 | A1 | 9/2019 | Dotterweich | |
| 2020/0029684 | A1 | 1/2020 | Jiang | |

FOREIGN PATENT DOCUMENTS

| | | | |
|---|---|---|---|
| DE | 4321853 | A1 | 1/1995 |
| DE | 29515948 | U1 | 1/1996 |
| EP | 1492432 | B1 | 10/2016 |
| WO | WO 2013000149 | A1 | 1/2013 |

* cited by examiner

RETAINER AND FRAME HAVING SAME

CROSS-REFERENCE TO RELATED APPLICATIONS

The present application claims priority to Chinese Utility Model Application CN 202120546345.2 filed Mar. 16, 2021. The disclosure of the application is incorporated herein for all purposes by reference in its entirety.

FIELD OF THE INVENTION

The present invention generally relates to foldable frames and retainers to prevent accidental unfolding of the foldable frames.

BACKGROUND

Foldable tables are more and more popular these days. A typical foldable table usually includes a tabletop and a foldable frame to support the tabletop. However, many existing foldable tables are configured with no or little means to prevent the tables from accidental unfolding. As such, they are inconvenient and unsafe to carry around.

Given the current state of the art, there remains a need for foldable frames and tables that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides foldable frames with retainers that prevent the frames from accidental unfolding.

In various exemplary embodiments, the present disclosure provides a frame including a first mounting assembly, a second mounting assembly, and one or more retainers configured to retain the first and second mounting assemblies in the folded position. Each of the first and second mounting assemblies has a proximal portion and a distal portion. The first and second mounting assemblies are pivotally coupled with each other at the proximal portions such that the first and second mounting assemblies are rotatable with respect to each other between a folded position and an unfolded position. Each retainer includes a first coupler and a second coupler. The first coupler includes a first base and at least two lever arms. Each of the at least two lever arms of the first coupler includes a first lever portion extended from the first base and a second lever portion extended from the first lever portion and arched outwardly relative to the first lever portion. The second coupler includes a second base and a receptacle. The receptacle of the second coupler includes an opening, an expansion portion and a contraction portion between the opening and the expansion portion. The first base of the first coupler is coupled with the distal portion of one of the first and second mounting assemblies and the second base of the second coupler is coupled with the distal portion of the other of the first and second mounting assemblies. When the first and second mounting assemblies are in the folded position, the first base of the first coupler and the second base of the second coupler are disposed adjacent to each other and the opening of the second coupler faces the first coupler, thereby allowing insertion of the at least two lever arms of the first coupler into the receptacle of the second coupler. The expansion portion of the second coupler is recessed to accommodate the second lever portions of the at least two lever arms of the first coupler. The contraction portion of the second coupler is positioned corresponding to a junction collectively formed by the first and second lever portions of the at least two lever arms of the first coupler and sized to retain, absent of an external force, the second lever portions of the at least two lever arms of the first coupler in the expansion portion of the second coupler.

In some exemplary embodiments, for each of the at least two lever arms of the first coupler, the first lever portion is substantially straight.

In some exemplary embodiments, the first lever portions of the at least two lever arms of the first coupler are splayed out.

In an exemplary embodiment, the first lever portion of one lever arm and the first lever portion of another lever arm of the first coupler collectively form an angle that is between about 5° and about 30° or between about 10° and about 25°.

In some exemplary embodiments, the at least two lever arms of the first coupler collectively form a central axis that is substantially perpendicular to the first base of the first coupler.

In an exemplary embodiment, the opening of the receptacle of the second coupler is tapered to aid insertion of the at least two lever arms of the first coupler into the receptacle of the second coupler.

In an exemplary embodiment, tips of the second lever portions of the at least two lever arms of the first coupler are slanted toward each other to aid insertion of the at least two lever arms of the first coupler into the receptacle of the second coupler.

In some exemplary embodiments, each of the first and second mounting assemblies includes a first bar and a second bar. Proximal end portions of the first bars of the first and second mounting assemblies are pivotally coupled with each other. Proximal end portions of the second bars of the first and second mounting assemblies are pivotally coupled with each other. When the first and second mounting assemblies is in the folded position, distal end portions of the first bars of the first and second mounting assemblies are adjacent to each other, and distal end portions of the second bars of the first and second mounting assemblies are adjacent to each other. The one or more retainers includes two retainers. The first base of the first coupler and the second base of the second coupler of one retainer are coupled with the distal end portions of the first bars of the first and second mounting assemblies. The first base of the first coupler and the second base of the second coupler of the other retainer are coupled with the distal end portions of the second bars of the first and second mounting assemblies.

In an exemplary embodiment, the distal end portions of the first and second bars are tubular. Each of the first base of the first coupler and the second base of the second coupler includes an insertion portion inserted into the distal end portion of the first or second bar.

In another exemplary embodiment, each of the first base of the first coupler and the second base of the second coupler includes a wall mounted on a side of the distal end portion of the first or second bar.

In some exemplary embodiments, the frame further includes a third bar, first and second leg assemblies, and first and second supporting assemblies. The third bar has an end portion coupled with the proximal end portions of the first bars of the first and second mounting assemblies and another end portion coupled with the proximal end portions of the second bars of the first and second mounting assemblies. The first leg assembly is coupled with the first mounting assembly and rotatable with respect to the first mounting assembly. The second leg assembly is coupled with the second mounting assembly and rotatable with respect to the second mounting assembly. The first supporting assembly is pivotally coupled with the first leg assembly to control rotation of the first leg assembly with respect to the first mounting assembly or help stabilize the first leg assembly. The second supporting assembly is pivotally coupled with the second leg assembly to control rotation of the second leg assembly with respect to the second mounting assembly or help stabilize the second leg assembly.

In some exemplary embodiments, each of the first and second supporting assemblies includes a first supporting member, a slider and at least two second supporting members. Corresponding to each of the first and second supporting assemblies, the frame includes a fixing member and a connecting member. The first supporting member has an end portion pivotally coupled with the first or second leg assembly. The slider is coupled with the first supporting member and selectively movable along the first supporting member. Each of at least two second supporting members has an end portion coupled with the slider and another end portion coupled with the fixing member. The connecting member pivotally couples the fixing member with the third bar.

In an exemplary embodiment, the connecting member includes a hole coupled with a shaft of a third coupler that is disposed at a middle portion of the third bar.

In some exemplary embodiments, the frame further includes first and second clips. The first clip is disposed at the first mounting assembly to grip a leg of the first leg assembly when the first leg assembly is in the storage position. The second clip is disposed at the second mounting assembly to grip a leg of the second leg assembly when the second leg assembly is in the storage position.

In some exemplary embodiments, the first and second mounting assemblies are symmetric with respect to each other.

In various exemplary embodiments, the present disclosure provides a retainer for retaining pivotally coupled first and second assemblies when they are in a folded position. The retainer includes a first coupler and a second coupler. The first coupler includes a first base and at least two lever arms. Each of the at least two lever arms of the first coupler includes a first lever portion extended from the first base and a second lever portion extended from the first lever portion and arched outwardly relative to the first lever portion. The second coupler includes a second base and a receptacle. The receptacle of the second coupler includes an opening, an expansion portion and a contraction portion between the opening and the expansion portion. The first base of the first coupler is coupled with the distal portion of one of the first and second assemblies and the second base of the second coupler is coupled with the distal portion of the other of the first and second assemblies. When the first and second assemblies are in the folded position, the first base of the first coupler and the second base of the second coupler are disposed adjacent to each other and the opening of the second coupler faces the first coupler, thereby allowing insertion of the at least two lever arms of the first coupler into the receptacle of the second coupler. The expansion portion of the second coupler is recessed to accommodate the second lever portions of the at least two lever arms of the first coupler. The contraction portion of the second coupler is positioned corresponding to a junction collectively formed by the first and second lever portions of the at least two lever arms of the first coupler and sized to retain, absent of an external force, the second lever portions of the at least two lever arms of the first coupler in the expansion portion of the second coupler.

In an exemplary embodiment, for each of the at least two lever arms of the first coupler, the first lever portion is substantially straight.

In some exemplary embodiments, the first lever portion of one lever arm and the first lever portion of another lever arm of the first coupler collectively form an angle that is between about 5° and about 30° or between about 10° and about 25°.

In some exemplary embodiments, the first lever portions of the at least two lever arms of the first coupler are splayed out.

In some exemplary embodiments, each of the at least two lever arms of the first coupler is elastically resilient.

The retainers and frames of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1A:
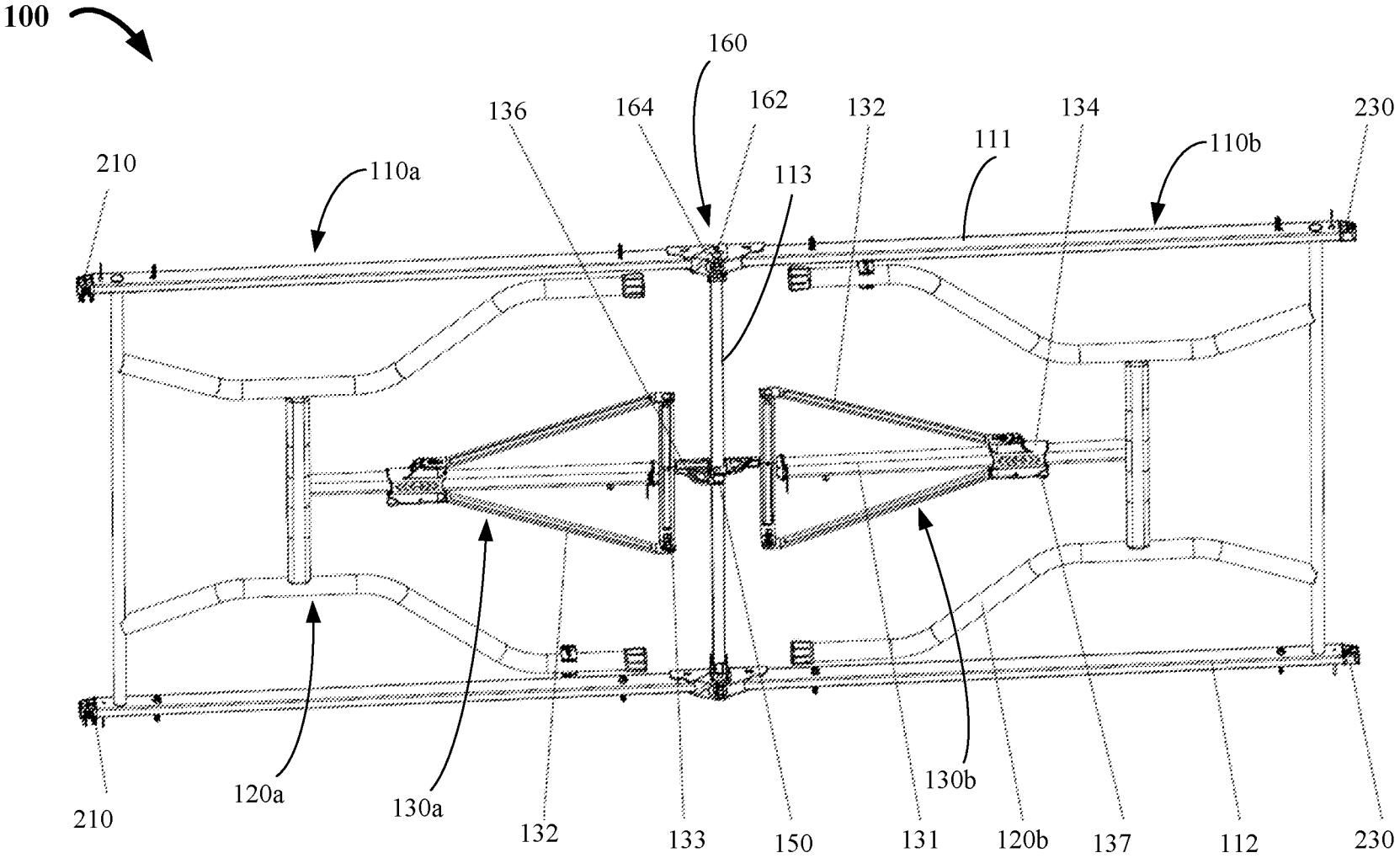
FIG. 1A is a schematic perspective view illustrating an exemplary foldable frame in a partially unfolded state in accordance with exemplary embodiments of the present disclosure.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementation of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of retainers and foldable frames supported by foldable frames. A foldable frame generally includes a first mounting assembly, a second mounting assembly, and one or more retainers. The first and second mounting assemblies are pivotally connected to each other and are rotatable with respect to each other between a folded position and an unfolded position. The one or more retainers are configured to retain the first and second mounting assemblies in the folded position. For instance, in some exemplary embodiments, each retainer includes a first coupler and a second coupler, with one disposed at the first mounting assembly and the other at the second mounting assembly. When the first and second mounting assemblies are in the folded position, the first and second couplers of each retainer engage with each other, thereby retaining the first and second mounting assemblies in the folded position and preventing the foldable frame from accidental unfolding.

Referring to FIGS. 1A, 2A, 3 and 4, there is depicted exemplary foldable frame 100 in accordance with some exemplary embodiments of the present disclosure. As shown, foldable frame 100 includes first mounting assembly and second mounting assemblies such as mounting assemblies 110*a* and 110*b*. The first and second mounting assemblies can be, but do not have to be, identical or symmetric to each other. As a non-limiting example, the first and second mounting assemblies are illustrated to be substantially the same and substantially symmetrical to each other.

Figure 2A:
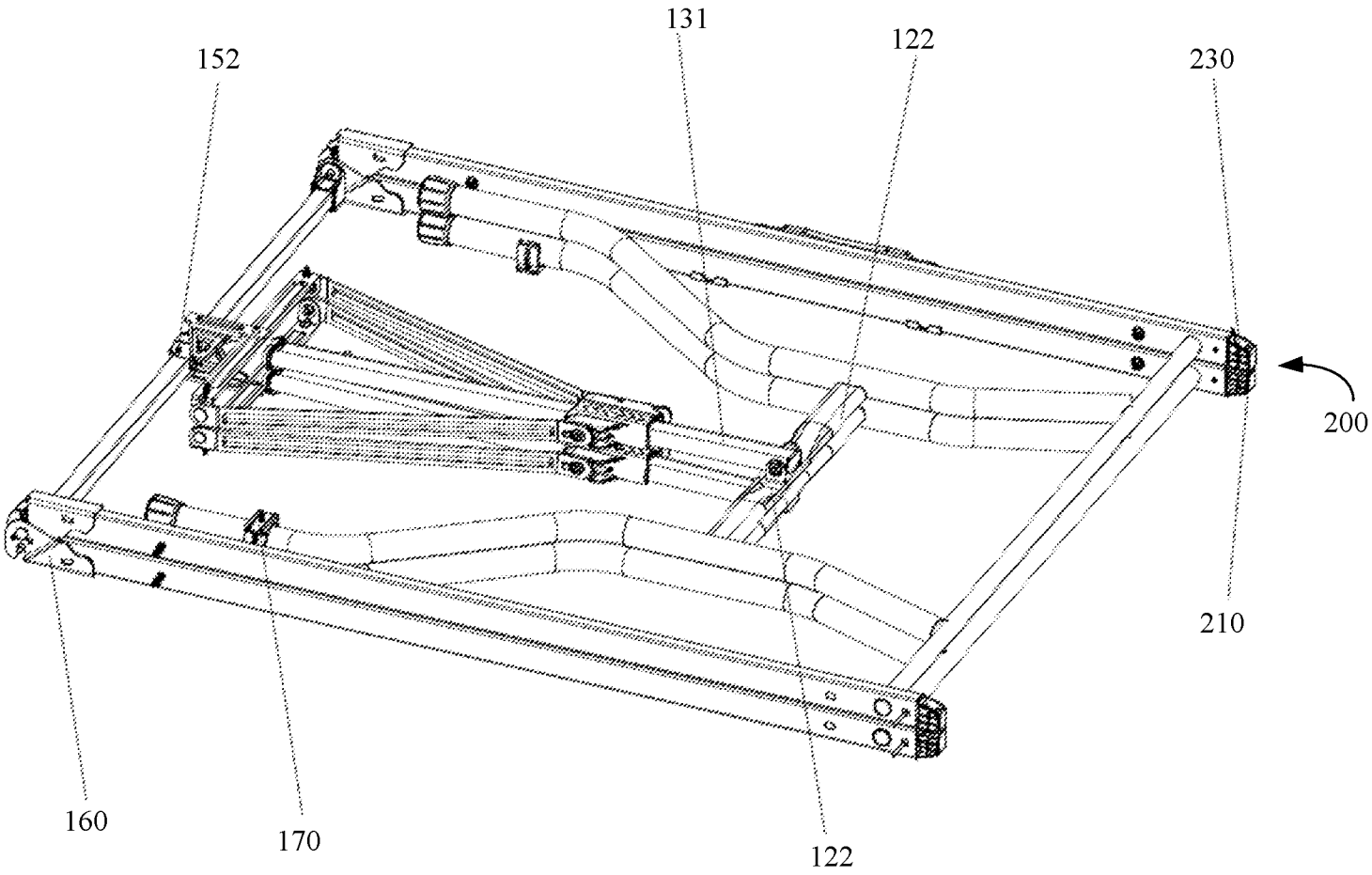
FIG. 2A is a schematic perspective view illustrating the foldable table of FIG. 1A in a folded state in accordance with exemplary embodiments of the present disclosure.
Figure 2B:
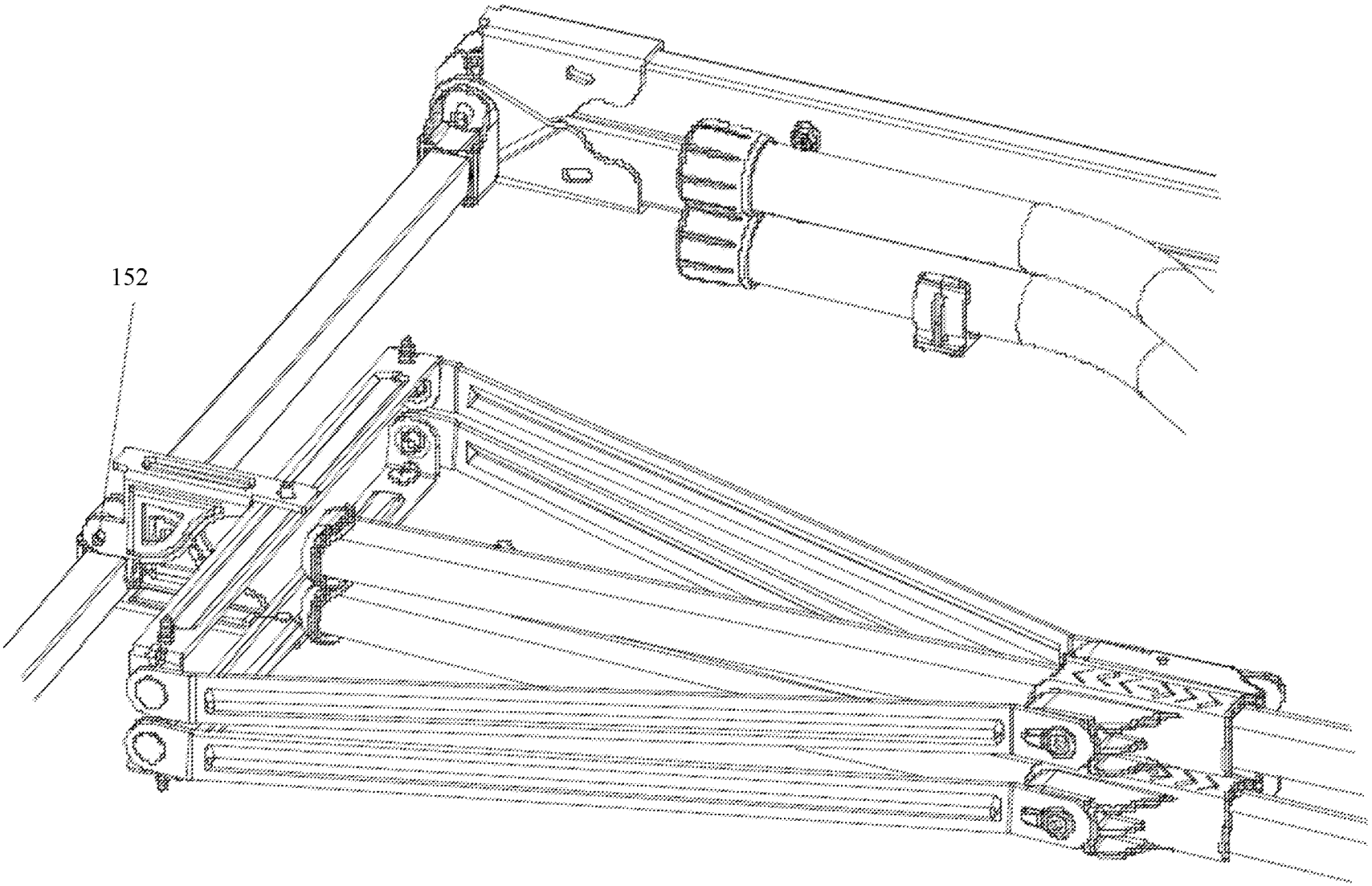
FIG. 2B is an enlarged view illustrating a portion of the foldable frame of FIG. 2A.
Figure 3:
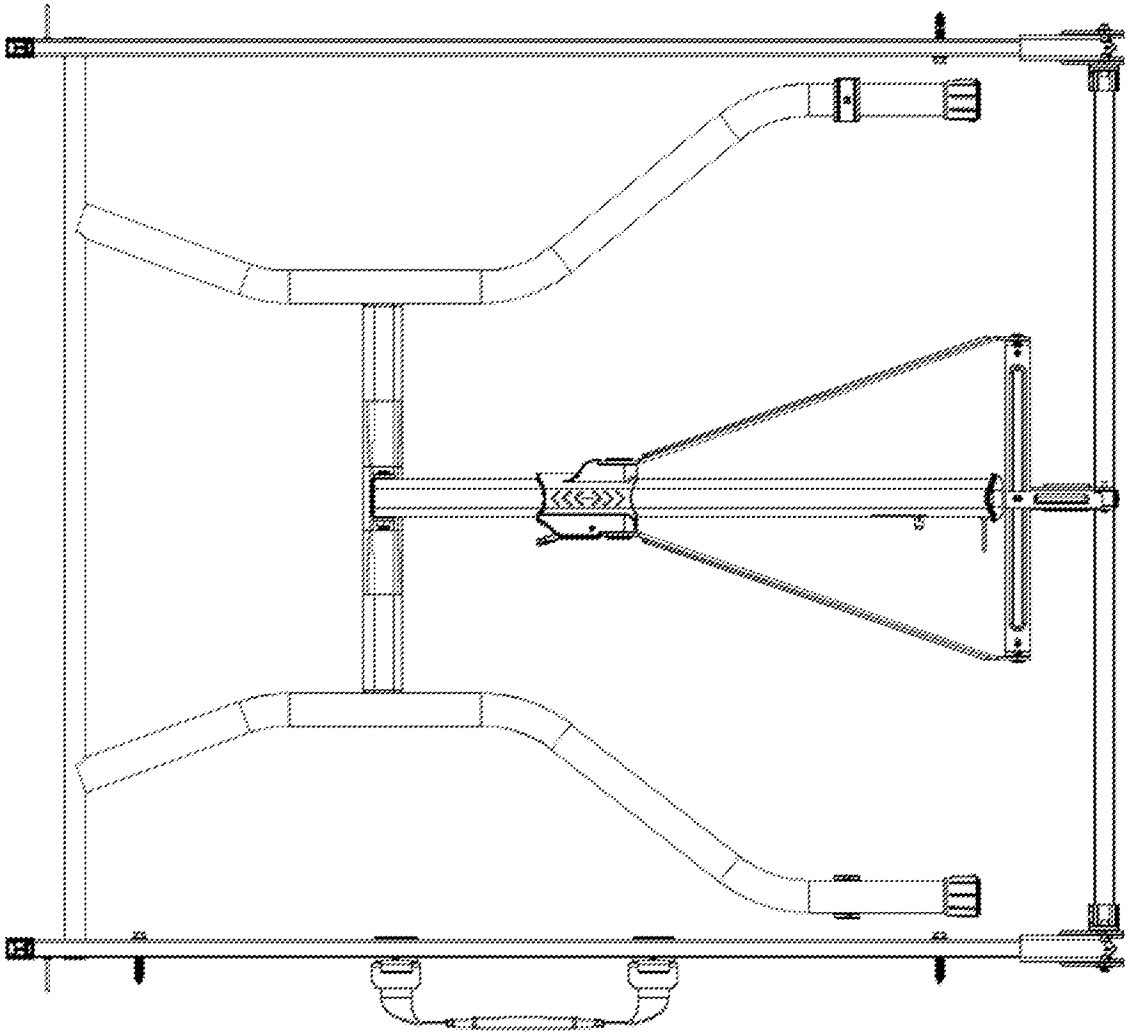
FIG. 3 is a schematic top view illustrating the foldable table of FIG. 1A in the folded state in accordance with exemplary embodiments of the present disclosure.
Figure 4:
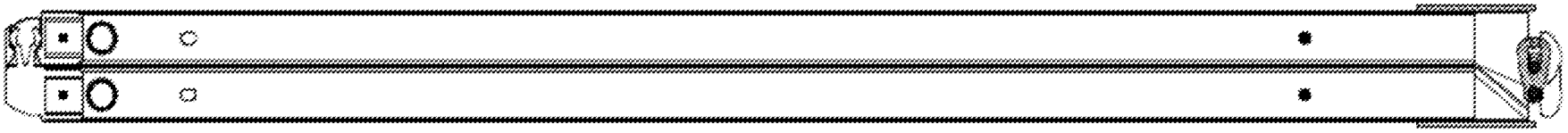
FIG. 4 is a schematic and partially cutout side view illustrating the foldable frame of FIG. 1A in the folded state in accordance with exemplary embodiments of the present disclosure.

The first and second mounting assemblies are pivotally coupled with each other at their proximal portions such that the first and second mounting assemblies are rotatable with respect to each other between an unfolded position as illustrated in FIG. 1A and a folded position as illustrated in FIG. 2A. In the unfolded position as illustrated in FIG. 1A, the proximal portions of the first and second mounting assemblies are the portions in the middle of the figure, the distal portion of first mounting assembly 110*a* is the portion at the left side of the figure and away from second mounting assembly 110*b*, and the distal portion of second mounting assembly 110*b* is the portion at the right side of the figure and away from first mounting assembly 110*a*.

In some exemplary embodiments, each of the first and second mounting assemblies includes a first bar such as first bar 111 and a second bar such as second bar 112. The proximal end portions of the first bars of the first and second mounting assemblies are pivotally coupled with each other, for instance, by a coupler such as coupler 160. Similarly, the proximal end portions of the second bars of the first and second mounting assemblies are pivotally coupled with each other, for instance, by a coupler, which can be the same as coupler 160 or different from coupler 160. The first and second mounting assemblies are rotatable with respect to each other around a pivotal axis, such as pivotal axis 162. In some exemplary embodiments, at least one coupler includes an auto-lock mechanism, such as auto-lock mechanism 164, configured to selectively allow the first and second mounting assemblies to fold and unfold. However, the present disclosure is not limited thereto. Other pivoting mechanisms can be used, such as those disclosed in U.S. patent application Ser. No. 16/838,939 (now U.S. Pat. No. 10,863,819 B1), U.S. patent application Ser. No. 16/839,337 (now U.S. Pat. No. 10,806,246 B2) and U.S. patent application Ser. No. 17/368,284, the disclosure of each application is incorporated herein for all purposes by reference in its entirety.

When the first and second mounting assemblies is in the folded position, the distal end portions of the first bars of the first and second mounting assemblies are adjacent to each other, and the distal end portions of the second bars of the first and second mounting assemblies are adjacent to each other.

In some exemplary embodiments, frame 100 includes a third bar such as third bar 113. The third bar has an end portion coupled with the proximal end portions of the first bars of the first and second mounting assemblies and another end portion coupled with the proximal end portions of the second bars of the first and second mounting assemblies. In some exemplary embodiments, the third bar has an end portion coupled with the coupler that connects the proximal end portions of the first bars of the first and second mounting assemblies, and another end portion coupled with the coupler that connects the proximal end portions of the second bars of the first and second mounting assemblies.

In some exemplary embodiments, frame 100 includes one or more retainers to retain the first and second mounting assemblies in the folded position. Generally, a retainer includes a first coupler and a second coupler, with one coupler (either the first or second coupler) disposed at the first mounting assembly and the other coupler disposed at the second mounting assembly. For instance, in an exemplary embodiment, the first coupler of each retainer is coupled with the first mounting assembly, and the second coupler of each retainer is coupled with the second mounting assembly. In another exemplary embodiment, the first coupler of each retainer is coupled with the second mounting assembly, and the second coupler of each retainer is coupled with the first mounting assembly. In still another exemplary embodiment, the first coupler of one retainer is coupled with the first mounting assembly and the second coupler of one retainer is coupled with the second mounting assembly while the first coupler of another retainer is coupled with the second mounting assembly and the second coupler of another retainer is coupled with the first mounting assembly.

When the first and second mounting assemblies are in the folded position, the first and second couplers engage with each other and thus retain the first and second mounting assemblies in the folded position. For instance, referring to FIGS. 1A, 2A and 5A-5C, in some embodiments, frame 100 includes one or more retainers 200 to retain the first and second mounting assemblies in the folded position. Retainer 200 includes first coupler 210 and second coupler 230.

First coupler 210 includes a first base such as first base 212 configured to couple the first coupler with the distal portion of the first or second mounting assembly, e.g., the distal end portion of first bar 111 or second bar 112. For instance, in some exemplary embodiments, the distal end portion of the first or second bar is tubular, and first base 212 includes an insertion portion such as insertion portion 214 configured to be inserted into the distal end portion of the first or second bar. In some exemplary embodiments, the insertion portion 214 is further secured to the distal end portion of the first or second bar by a fastener or the like.

First coupler 210 also includes at least two lever arms (e.g., 2, 3, 4 or more lever arms) each extended from the first base. For instance, as a non-limiting example, in some embodiments, first coupler 210 includes two lever arms 220. The two lever arms can be, but do not have to be, identical or symmetric to each other. As a non-limiting example, the two lever arms are illustrated to be substantially the same and substantially symmetrical to each other.

Each of the at least two lever arms of the first coupler is configured to be elastically resilient to facilitate engagement of the first coupler with the second coupler or disengagement of the first coupler from the second coupler. For instance, in some exemplary embodiments, lever arm 220 includes a plurality of portions such as first lever portion 222 and second lever portion 224. The first lever portion is extended from the first base, and the second lever portion extended from the first lever portion and arched outwardly relative to the first lever portion.

Figure 5A:
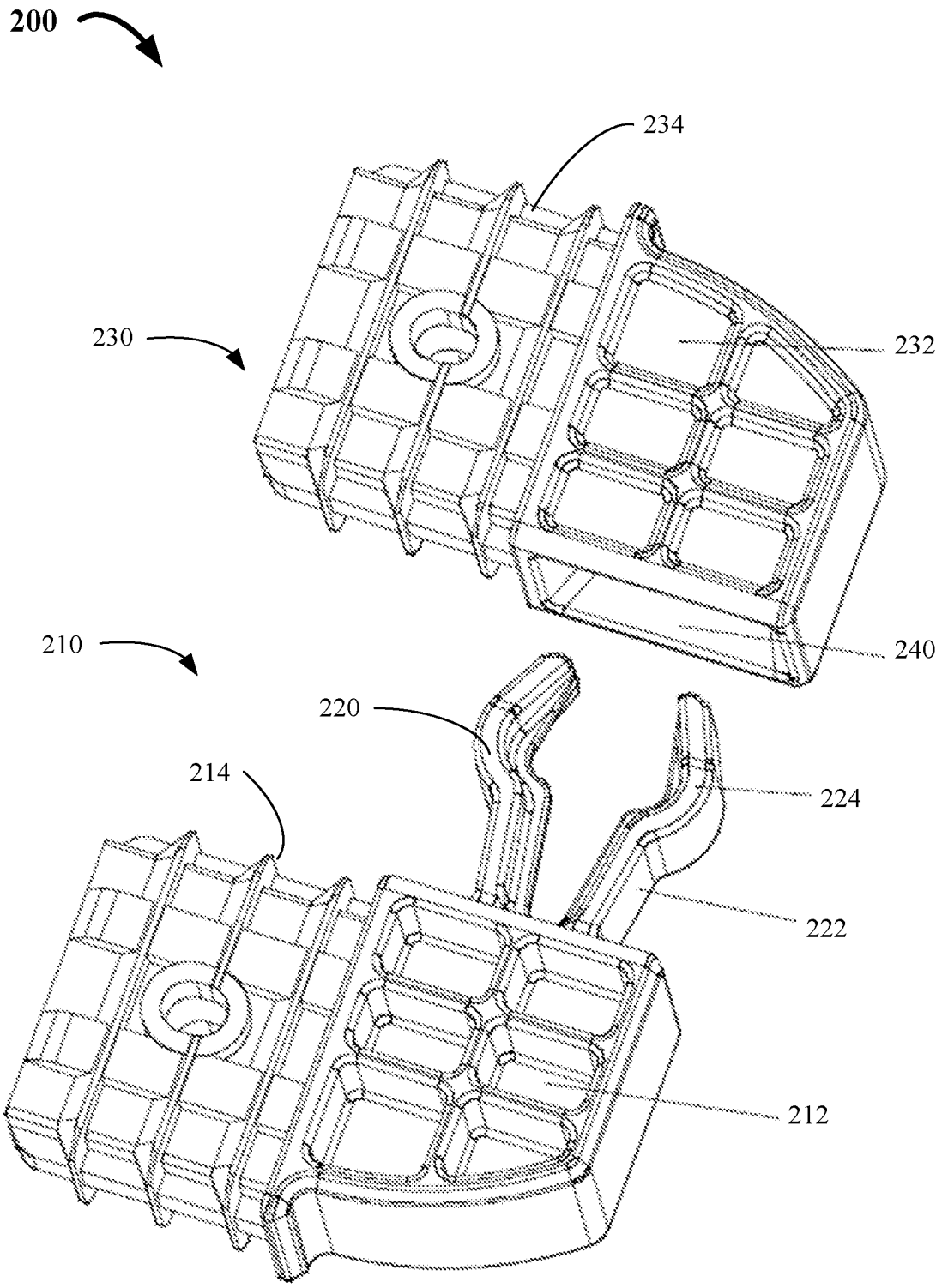
FIG. 5A is a schematic perspective view illustrating a retainer in a disengaged state in accordance with exemplary embodiments of the present disclosure.
Figure 5B:
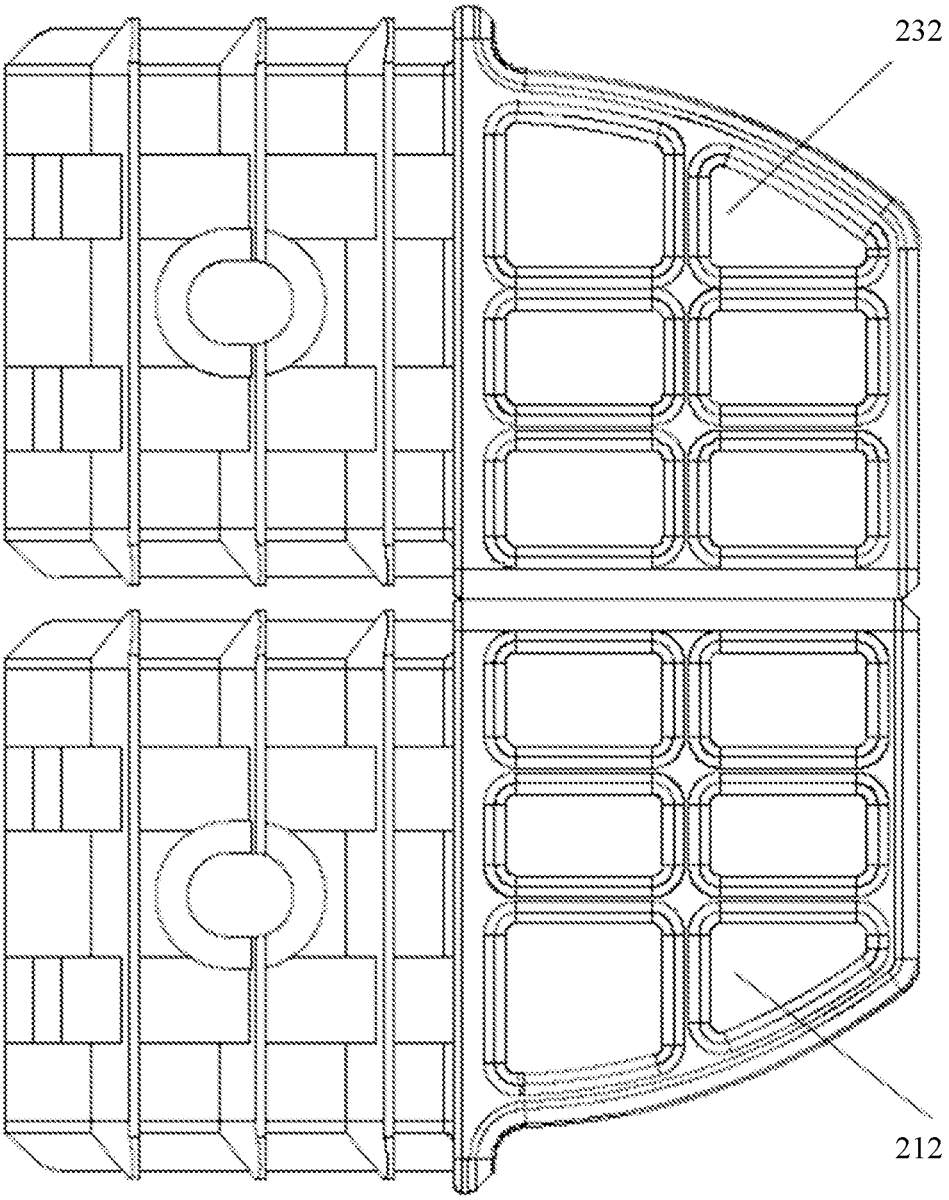
FIG. 5B is a schematic perspective view illustrating the retainer of FIG. 5A in an engaged state in accordance with exemplary embodiments of the present disclosure.
Figure 5C:
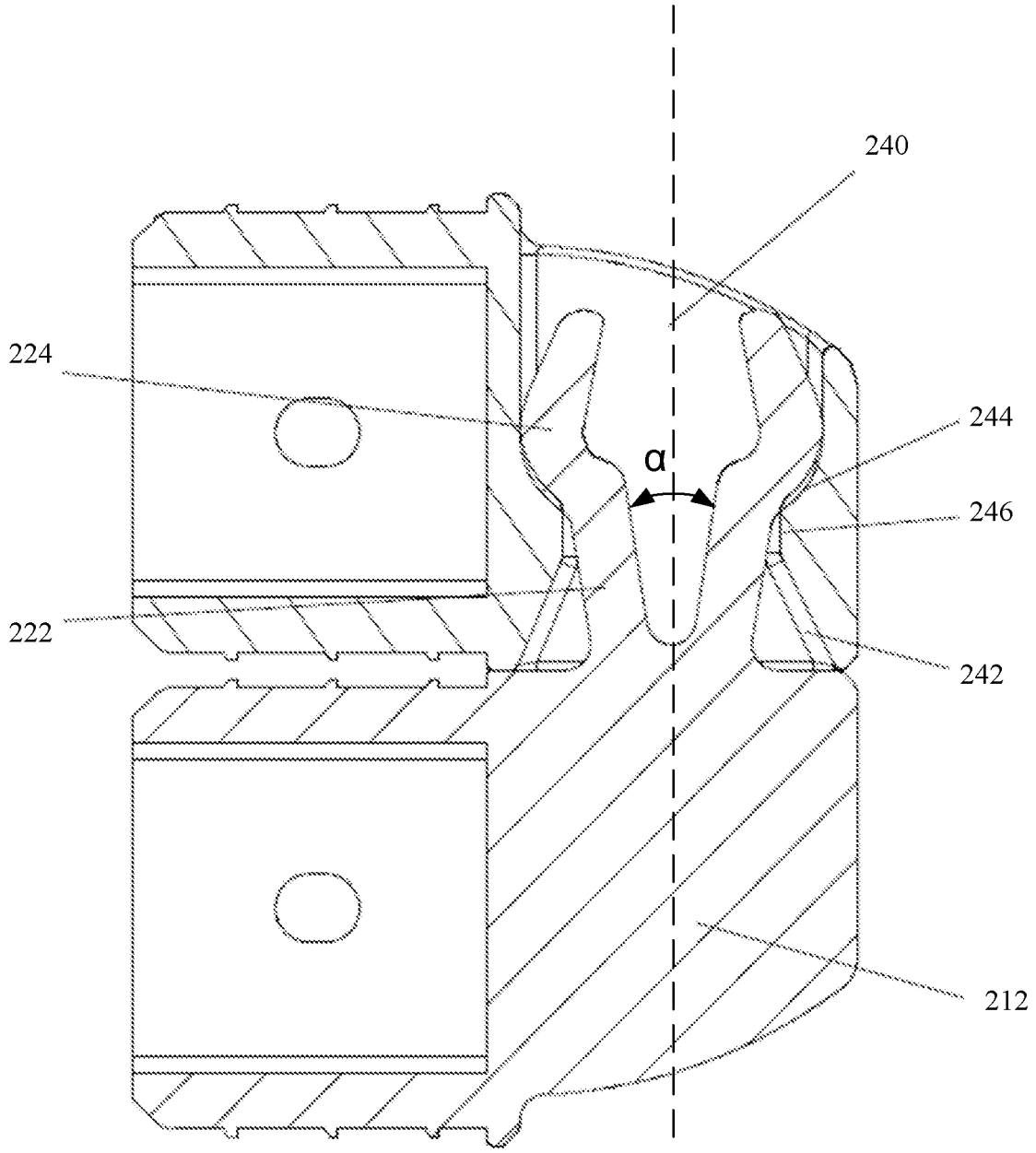
FIG. 5C is a schematic cross-sectional view the retainer of FIG. 5A in an engaged state in accordance with exemplary embodiments of the present disclosure.

In some exemplary embodiments, the first lever portion is substantially straight. In some exemplary embodiments, the first lever portion is splayed out, e.g., the first lever portion of one lever arm and the first lever portion of another lever arm of the first coupler collectively form an angle a as illustrated in FIG. 5C. In some exemplary embodiments, the angle is between about 5° and about 30°, between about 10° and about 25°, or between about 15° and about 20°. In some exemplary embodiments, the lever arms of the first coupler collectively form a central axis, illustrated by the dash line in FIG. 5C, that is substantially perpendicular to the first base (e.g., the insertion portion of the first base) of the first coupler.

Second coupler 230 includes a second base such as second base 232. Similar to the first base of the first coupler, second base 232 is configured to couple the second coupler with the distal portion of the first or second mounting assembly, e.g., the distal end portion of first bar 111 or second bar 112. For instance, in some exemplary embodiments, the distal end portion of the first or second bar is tubular, and second base 232 includes an insertion portion such as insertion portion 234 configured to be inserted into the distal end portion of the first or second bar. In some exemplary embodiments, the insertion portion 234 is further secured to the distal end portion of the first or second bar by a fastener or the like.

Second coupler 230 also includes a receptacle such as receptacle 240 to receive the lever arms of the first coupler when the first and second mounting assemblies are in the folded position. Receptacle 240 includes an opening such as opening 242 that faces the first coupler when the first and second mounting assemblies are in the folded position, thereby allowing insertion of the lever arms of the first coupler into the receptacle.

Receptacle 240 also includes a plurality of hollow portions. For instance, in some embodiments, receptacle 240 includes expansion portion 244 and contraction portion 246 formed between the opening and the expansion portion. At expansion portion 244, the interior surface of the receptacle is recessed outwardly to accommodate the second lever portions of the lever arms of the first coupler. In an exemplary embodiment, the interior surface of the receptacle is arched in accordance with the arched second lever portions of the lever arms of the first coupler. At contraction portion 246, the interior surface of the receptacle is protruded inwardly. The contraction portion of the second coupler is positioned corresponding to a junction collectively formed by the first and second lever portions of the at least two lever arms of the first coupler.

When folding the first and second mounting assemblies, the contraction portion of the second coupler presses the lever arms of the first coupler toward each other, thereby allowing second lever portions 224 of the lever arms to enter into expansion portion 244 of the second coupler. Once the second lever portions have entered into expansion portion 244 of the second coupler, the lever arms of the first coupler open up and return to their original state in the absence of an external force. As a result, the second lever portions of lever arms of the first coupler are retained by the contraction portion of the second coupler in the expansion portion of the second coupler. When unfolding the first and second mounting assemblies, the first and second couplers are being pulled away from each other. The contraction portion of the second coupler again squeezes the second lever portions of the at least two lever arms of the first coupler toward each other. This allows second lever portions 224 of the lever arms of the first coupler to be pulled out of expansion portion 244 of the second coupler, and thus disengages the first coupler from the second coupler.

In some exemplary embodiments, the opening of the receptacle of the second coupler is tapered to aid insertion of the lever arms of the first coupler into the receptacle of the second coupler. In some exemplary embodiments, tips of the second lever portions of the lever arms of the first coupler are slanted toward each other to aid insertion of the lever arms of the first coupler into the receptacle of the second coupler.

Figure 1B:
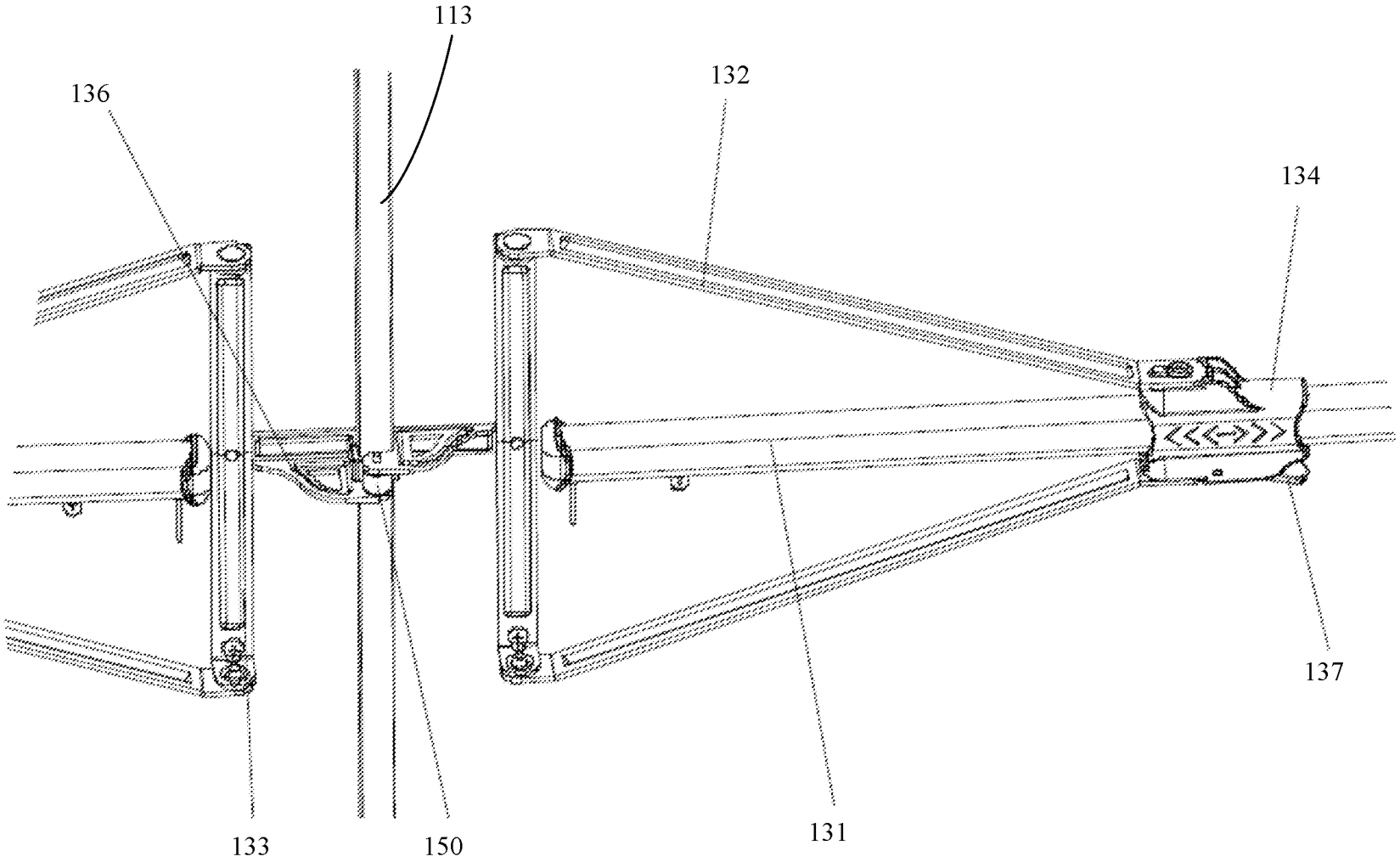
FIG. 1B is an enlarged view illustrating a portion of the foldable frame of FIG. 1A.

In some exemplary embodiments, frame 100 includes a first leg assembly such as first leg assembly 120*a* and a second leg assembly such as second leg assembly 120*b*. The first and second leg assemblies can be, but do not have to be, identical or symmetric to each other. As a non-limiting example, the first and second leg assemblies are illustrated to be substantially the same and substantially symmetrical to each other. The first leg assembly is coupled with the first mounting assembly and rotatable with respect to the first mounting assembly, and the second leg assembly coupled with the second mounting assembly and rotatable with respect to the second mounting assembly. In some exemplary embodiments, the first leg assembly is rotatable with respect to the first mounting assembly and the second leg assembly is rotatable with respect to the second mounting assembly between a use position and a storage position. In an exemplary embodiment, when in the use position, the first leg assembly is substantially perpendicular to the first mounting assembly and the second leg assembly is substantially perpendicular to the second mounting assembly. When in the storage position, the first leg assembly lies approximately in the same plane as the first mounting assembly and the second leg assembly lies approximately in the same plane as the second mounting assembly, as illustrated in FIGS. 1A and 1B.

In some exemplary embodiments, frame 100 includes a plurality of clips or the like to hold the first and second leg assemblies in the storage position. For instance, as a non-limiting example, two clips 170 are illustrated. One clip is disposed at the first mounting assembly (e.g., second bar 112 of the first mounting assembly) to grip a leg of the first leg assembly when the first leg assembly is in the storage position. The other clip is disposed at the second mounting assembly (e.g., first bar 111 of the second mounting assembly) to grip a leg of the second leg assembly when the second leg assembly is in the storage position.

In some exemplary embodiments, to control the rotation of the first and second leg assemblies and/or to help stabilize the first and second leg assemblies when they are in use, frame 100 includes a first supporting assembly such as first supporting assembly 130*a* and a second supporting assembly such as second supporting assembly 130*b*. The first supporting assembly is pivotally coupled with the first leg assembly to control rotation of the first leg assembly with respect to the first mounting assembly or help stabilize the first leg assembly when it is in use. The second supporting assembly is pivotally coupled with the second leg assembly to control rotation of the second leg assembly with respect to the second mounting assembly or help stabilize the second leg assembly when it is in use. The first and second supporting assemblies can be, but do not have to be, identical or symmetric to each other. As a non-limiting example, the first and second supporting assemblies are illustrated to be substantially the same and substantially symmetrical to each other. Examples of supporting assemblies are disposed in U.S. patent application Se. No.: 16/951,461, and U.S. patent application Ser. No. 17/368,284, the disclosure of each application is incorporated herein for all purposes by reference in its entirety.

Referring to FIGS. 1A-3, in some embodiments, each of the first and second supporting assemblies includes a first supporting member, a slider, and at least two second supporting members. For instance, in an exemplary embodiment, the first or second supporting assembly includes first supporting member 131, slider 134, and two second supporting members 132. In some exemplary embodiments, corresponding to the first or second supporting assembly or corresponding to each of the first and second supporting assemblies, the frame includes a fixing member, such as fixing member 133, and a connecting member, such as connecting member 136.

The first supporting member has an end portion pivotally coupled with the first or second leg assembly, e.g., coupled with lateral bar 122 of the first or second leg assembly. The slider is coupled with the first supporting member. The slider is selectively movable along the first supporting member, e.g., the slider can be locked, for instance by locking mechanism 137 or a fastener or the like, at one or more desired positions at the first supporting member. One desired position corresponds to when the first or second leg assembly is in the use position. Locking of the slider relative to the first supporting member prohibits the first or second leg assembly from rotating with respect to the first or second mounting assembly. Each of the second supporting member has an end portion coupled with the slider and another end portion coupled with the fixing member.

The connecting member pivotally couples the fixing member with the third bar. For instance, in an embodiment, the connecting member is fixedly coupled with the fixing member and pivotally coupled with the third bar. In another embodiment, the connecting member is pivotally coupled with the fixing member and fixedly coupled with the third bar. In some exemplary embodiments, the connecting member is pivotally coupled with the third bar via a coupler, such as coupler 150, disposed at the third bar. In an exemplary embodiment, the coupler is disposed at a middle portion of the third bar. In some exemplary embodiments, the connecting member includes a hole coupled with a shaft, such as shaft 152, of the coupler that is disposed at the third bar.

Figure 6A:
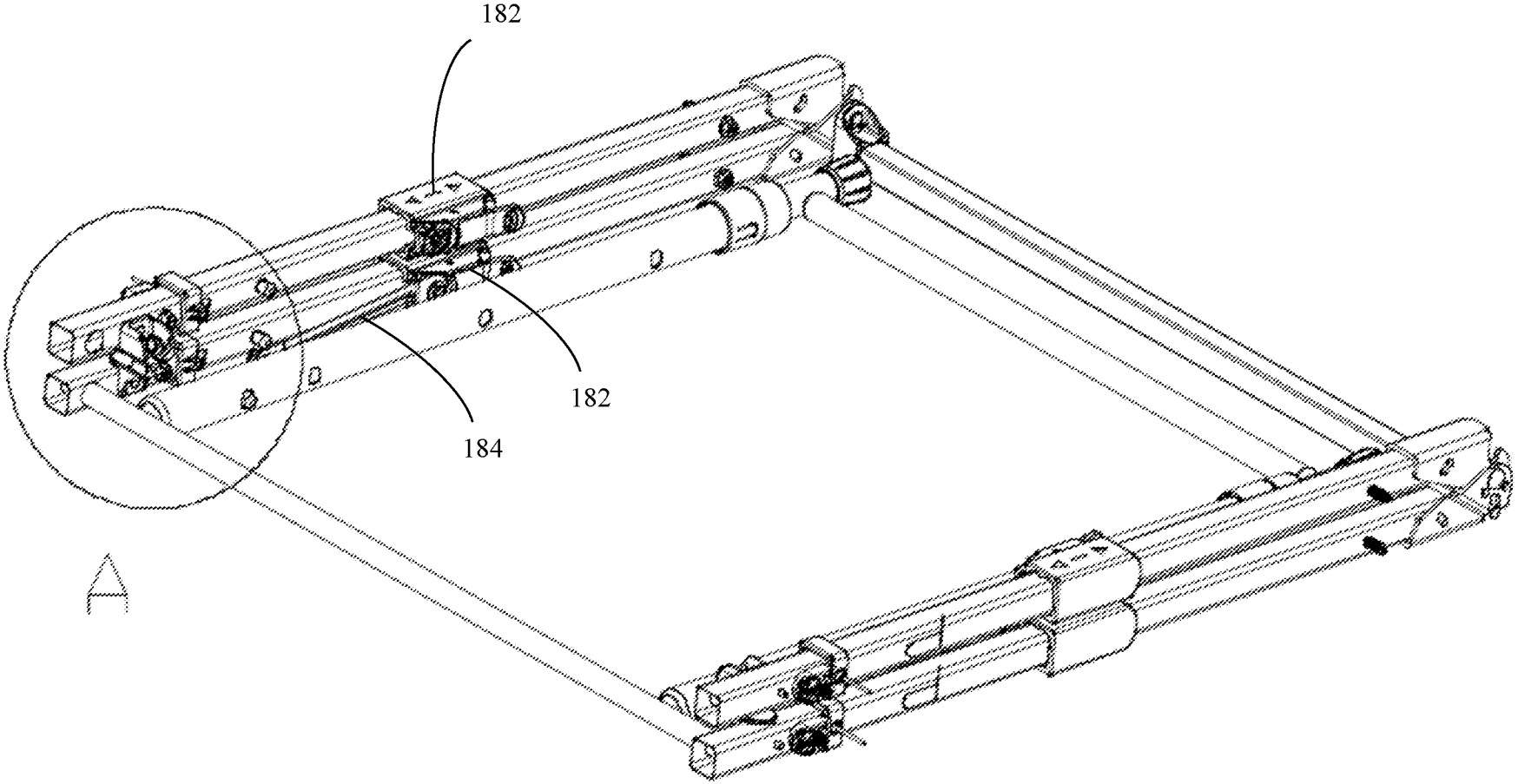
FIG. 6A is a schematic perspective view illustrating a portion of an exemplary foldable frame in a folded state in accordance with exemplary embodiments of the present disclosure.
Figure 6B:
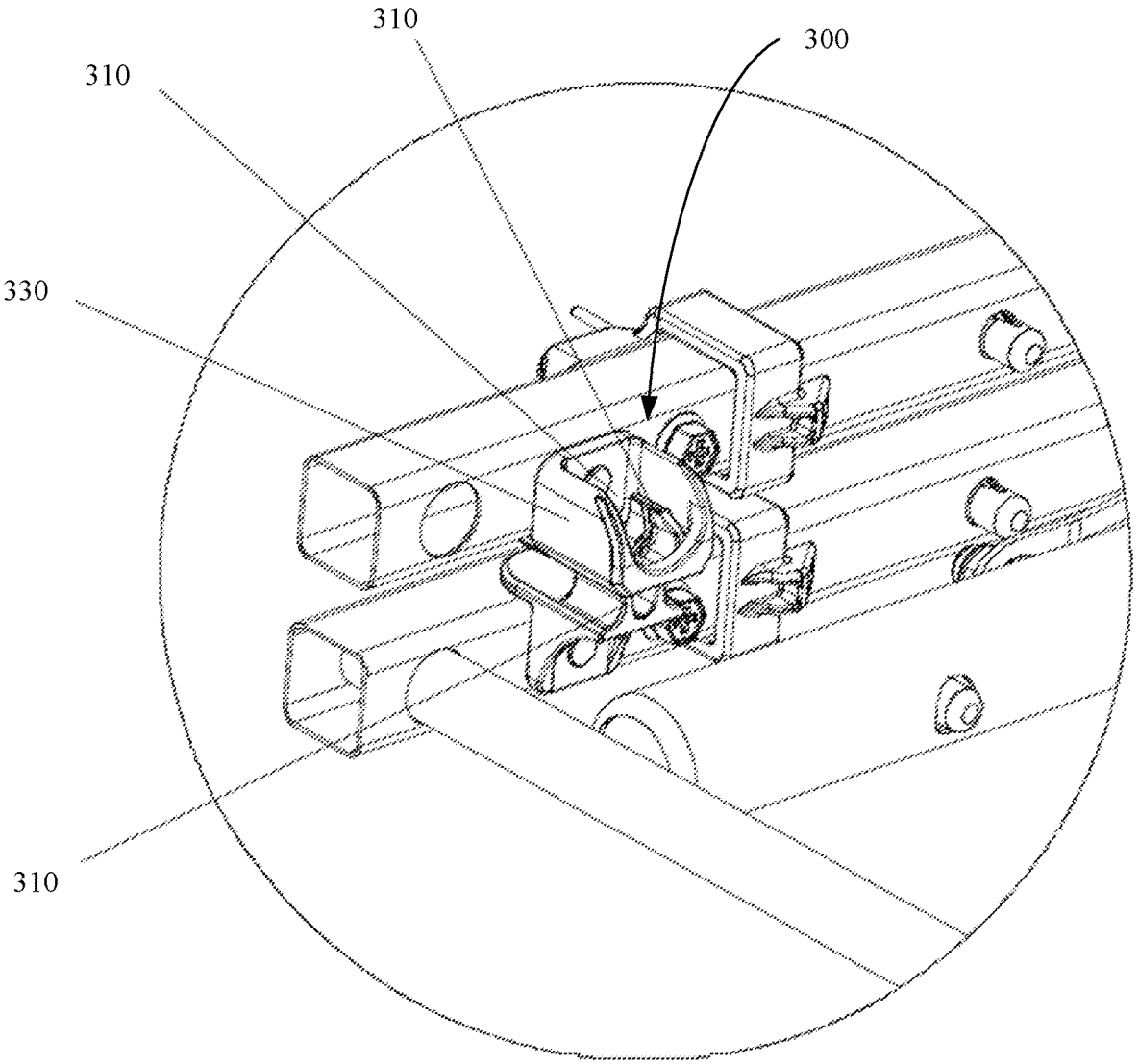
FIG. 6B is an enlarged view taken along circle A of FIG. 6A.

The frames disclosed herein can include additional, optional or alternative elements. For instance, as a non-limiting example, FIGS. 6A and 6B illustrate the first and second mounting assemblies being retained when in the folded position by an alternative retainer, such as retainer 300. Like retainer 200, retainer 300 includes a first coupler, such as first coupler 310, and a second coupler, such as second coupler 330. First coupler 310 and second coupler 330 engage with each other when the first and second mounting assemblies are in the folded position. For instance, in some embodiments, first coupler 310 includes two or more lever arms 210, and second coupler 330 includes receptacle 240 to receive and engage with the two or more lever arms 210. In some exemplary embodiments, first coupler 310 and second coupler 330 are disposed at or mounted on a side of the distal end portion of the first or second bar. For instance, in some embodiments, first coupler 310 includes wall 314 and second coupler 330 includes wall 334 to facilitate securing the first and second couplers on a side of the distal end portion of the first or second bar.

As another non-limiting example, FIGS. 6A and 6B illustrate the frame does not include the first and second supporting assemblies. Instead, the frame includes a plurality of sliders, such as slider 182 and a plurality of connecting members, such as connecting member 184, to control the rotation of the first and second leg assemblies. In the illustrated embodiment, slider 182 is disposed on the first or second bar of the first or second mounting assembly, and connecting member 182 has an end portion pivotally connected with the slider and another end portion pivotally connected with a leg of the first or second leg assembly.

The frames disclosed herein can be used as a table frame, a bench frame, a bed frame or the like. For instance, in some embodiments, a frame of the present invention is used to make a table. The table includes a first panel coupled with the first mounting assembly of the frame and a second panel coupled with the second mounting assembly of the frame. Such a table is foldable in half.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bar could be termed a second bar, and, similarly, a second bar could be termed a first bar, without changing the meaning of the description, so long as all occurrences of the "first bar" are renamed consistently and all occurrences of the "second bar" are renamed consistently.

What is claimed is:

1. A frame comprising:

a first mounting assembly and a second mounting assembly, each comprising a first bar and a second bar, wherein proximal end portions of the first bars of the first and second mounting assemblies are pivotally coupled with each other and proximal end portions of the second bars of the first and second mounting assemblies are pivotally coupled with each other such that the first and second mounting assemblies are rotatable with respect to each other between a folded position and an unfolded position, wherein when the first and second mounting assemblies is in the folded position, distal end portions of the first bars of the first and second mounting assemblies are adjacent to each other, and distal end portions of the second bars of the first and second mounting assemblies are adjacent to each other; and one or more retainers configured to retain the first and second mounting assemblies in the folded position, each retainer comprising a first coupler and a second coupler, wherein:

the first coupler comprising a first base and at least two lever arms, wherein each of the at least two lever arms of the first coupler comprises a first lever portion extended from the first base and a second lever portion extended from the first lever portion and arched outwardly relative to the first lever portion;

the second coupler comprises a second base and a receptacle, wherein the receptacle of the second coupler comprises an opening, an expansion portion and a contraction portion between the opening and the expansion portion;

the first base of the first coupler is disposed at and connected to the distal end portion of the first or second bar of the first mounting assembly and the second base of the second coupler is disposed at and connected to the distal end portion of the first or second bar of the second mounting assembly;

when the first and second mounting assemblies are in the folded position, the first base of the first coupler and the second base of the second coupler are disposed adjacent to each other, and the opening of the second coupler faces the first coupler, thereby allowing insertion of the at least two lever arms of the first coupler into the receptacle of the second coupler;

the expansion portion of the second coupler is recessed to accommodate the second lever portions of the at least two lever arms of the first coupler; and the contraction portion of the second coupler is positioned corresponding to a junction collectively formed by the first and second lever portions of the at least two lever arms of the first coupler and sized to retain, absent of an external force, the second lever portions of the at least two lever arms of the first coupler in the expansion portion of the second coupler.

2. The frame of claim 1, wherein for each of the at least two lever arms of the first coupler, the first lever portion is substantially straight.

3. The frame of claim 2, wherein the first lever portions of the at least two lever arms of the first coupler are splayed out.

4. The frame of claim 3, wherein the first lever portion of one lever arm and the first lever portion of another lever arm of the first coupler collectively form an angle that is between about 5° and about 30°.

5. The frame of claim 3, wherein the at least two lever arms of the first coupler collectively form a central axis that is substantially perpendicular to the first base of the first coupler.

6. The frame of claim 1, wherein the opening of the receptacle of the second coupler is tapered to aid insertion of the at least two lever arms of the first coupler into the receptacle of the second coupler.

7. The frame of claim 1, wherein tips of the second lever portions of the at least two lever arms of the first coupler are slanted toward each other to aid insertion of the at least two lever arms of the first coupler into the receptacle of the second coupler.

8. The frame of claim 1, wherein the one or more retainers comprises two retainers, wherein the first base of the first coupler and the second base of the second coupler of one retainer are coupled with the distal end portions of the first bars of the first and second mounting assemblies, and the first base of the first coupler and the second base of the second coupler of the other retainer are coupled with the distal end portions of the second bars of the first and second mounting assemblies.

9. The frame of claim 8, wherein the distal end portions of the first and second bars are tubular, and each of the first base of the first coupler and the second base of the second coupler comprises an insertion portion inserted into the distal end portion of the first or second bar.

10. The frame of claim 8, wherein each of the first base of the first coupler and the second base of the second coupler comprises a wall mounted on a side of the distal end portion of the first or second bar.

11. The frame of claim 8, further comprising:

a third bar having an end portion coupled with the proximal end portions of the first bars of the first and second mounting assemblies and another end portion coupled with the proximal end portions of the second bars of the first and second mounting assemblies;

a first leg assembly coupled with the first mounting assembly and rotatable with respect to the first mounting assembly;

a second leg assembly coupled with the second mounting assembly and rotatable with respect to the second mounting assembly;

a first supporting assembly pivotally coupled with the first leg assembly to control rotation of the first leg assembly with respect to the first mounting assembly or help stabilize the first leg assembly; and a second supporting assembly pivotally coupled with the second leg assembly to control rotation of the second leg assembly with respect to the second mounting assembly or help stabilize the second leg assembly.

12. The frame of claim 11, wherein each of the first and second supporting assemblies comprises a first supporting member, a slider and at least two second supporting members, and corresponding to each of the first and second supporting assemblies, the frame comprises a fixing member and a connecting member, wherein:

the first supporting member has an end portion pivotally coupled with the first or second leg assembly;

the slider is coupled with the first supporting member and selectively movable along the first supporting member;

each of at least two second supporting members has an end portion coupled with the slider and another end portion coupled with the fixing member; and the connecting member pivotally couples the fixing member with the third bar.

13. The frame of claim 12, wherein the connecting member comprises a hole coupled with a shaft of a third coupler that is disposed at a middle portion of the third bar.

14. The frame of claim 11, further comprising:

a first clip disposed at the first mounting assembly to grip a leg of the first leg assembly when the first leg assembly is in the storage position; and a second clip disposed at the second mounting assembly to grip a leg of the second leg assembly when the second leg assembly is in the storage position.

15. The frame of claim 1, wherein the first and second mounting assemblies are symmetric with respect to each other.

16. A retainer for retaining a first assembly with a second assembly, wherein (i) each of the first and second assemblies comprises a first bar and a second bar, (ii) proximal end portions of the first bars of the first and second mounting assemblies are pivotally coupled with each other and proximal end portions of the second bars of the first and second mounting assemblies are pivotally coupled with each other such that the first and second assemblies are rotatable with respect to each other between a folded position and an unfolded position, (iii) when the first and second mounting assemblies is in the folded position, distal end portions of the first bars of the first and second mounting assemblies are adjacent to each other, and distal end portions of the second bars of the first and second mounting assemblies are adjacent to each other, the retainer comprising:

a first coupler comprising a first base and at least two lever arms, wherein each of the at least two lever arms of the first coupler comprises a first lever portion extended from the first base and a second lever portion extended from the first lever portion and arched outwardly relative to the first lever portion; and a second coupler comprising a second base and a receptacle, wherein the receptacle of the second coupler comprises an opening, an expansion portion and a contraction portion between the opening and the expansion portion;

wherein:

the first base of the first coupler is configured to be disposed at and connected to the distal end portion of the first or second bar of the first mounting assembly and the second base of the second coupler is configured to be disposed at and connected to the distal end portion of the first or second bar of the second mounting assembly;

when the first and second assemblies are in the folded position, the first base of the first coupler and the second base of the second coupler are disposed adjacent to each other, and the opening of the second coupler faces the first coupler, thereby allowing insertion of the at least two lever arms of the first coupler into the receptacle;

the expansion portion of the second coupler is recessed to accommodate the second lever portions of the at least two lever arms of the first coupler; and the contraction portion of the second coupler is positioned at or adjacent to a junction collectively formed by the first and second lever portions of the at least two lever arms of the first coupler and sized to retain, absent of an external force, the second lever portions of the at least two lever arms of the first coupler in the expansion portion.

17. The retainer of claim 16, wherein for each of the at least two lever arms of the first coupler, the first lever portion is substantially straight.

18. The retainer of claim 17, wherein the first lever portion of one lever arm and the first lever portion of another lever arm of the first coupler collectively form an angle that is between about 5° and about 30°.

19. The retainer of claim 16, wherein the first lever portions of the at least two lever arms of the first coupler are splayed out.

20. The retainer of claim 16, wherein each of the at least two lever arms of the first coupler is elastically resilient.

21. The retainer of claim 16, wherein the distal end portions of the first and second bars are tubular, and each of the first base of the first coupler and the second base of the second coupler comprises an insertion portion inserted into the distal end portion of the first or second bar.

22. The retainer of claim 16, wherein each of the first base of the first coupler and the second base of the second coupler comprises a wall mounted on a side of the distal end portion of the first or second bar.

* * * * *